US012075854B2

(12) United States Patent
Dou et al.

(10) Patent No.: US 12,075,854 B2
(45) Date of Patent: Sep. 3, 2024

(54) COMPOSITE SOFT SUPPORT SIZELESS BRA

(71) Applicant: BIYUE (BEIJING) TECHNOLOGY CO., LTD.

(72) Inventors: Yaqian Dou, Beijing (CN); Yu Wang, Beijing (CN); Wenfang Lu, Beijing (CN)

(73) Assignee: BIYUE (BEIJING) TECHNOLOGY CO., LTD., Beijing (CN)

( * ) Notice: Subject to any disclaimer, the term of this patent is extended or adjusted under 35 U.S.C. 154(b) by 52 days.

(21) Appl. No.: 17/919,536

(22) PCT Filed: May 13, 2022

(86) PCT No.: PCT/CN2022/092705
§ 371 (c)(1),
(2) Date: Oct. 18, 2022

(87) PCT Pub. No.: WO2022/242562
PCT Pub. Date: Nov. 24, 2022

(65) Prior Publication Data

US 2023/0270183 A1 Aug. 31, 2023

(30) Foreign Application Priority Data

May 17, 2021 (CN) ..... 202121050070.X

(51) Int. Cl.
*A41C 3/12* (2006.01)

(52) U.S. Cl.
CPC ..... *A41C 3/128* (2013.01)

(58) Field of Classification Search
CPC ..... A41C 3/128; A41C 3/0057; A41C 3/14; A41C 3/142
(Continued)

(56) References Cited

U.S. PATENT DOCUMENTS 9,226,530 B1 * 1/2016 Silverman ..... A41C 3/0057
2013/0012101 A1 * 1/2013 Yen ..... A41C 3/128 450/52

(Continued)

FOREIGN PATENT DOCUMENTS

CN 111358062 7/2020
CN 212911714 4/2021

(Continued)

OTHER PUBLICATIONS

"International Search Report (Form PCT/ISA/210) of PCT/CN2022/092705," mailed on Jul. 28, 2022, pp. 1-4.

(Continued)

*Primary Examiner* — Timothy K Trieu
(74) *Attorney, Agent, or Firm* — HAUPTMAN HAM, LLP

(57) ABSTRACT

A composite soft support sizeless bra includes a front piece, a soft support rubber strip, a rear piece and a shoulder strap. The soft support strip is arranged on an inner side of the front piece and is connected is connected to a bottom part of the front piece by the shoulder strap to form a W shape, a U-shape, a straight shape, an arc shape or a curved shape. The rear piece and the front piece are integrally formed. The shoulder strap is used to connect the front piece and the rear piece. The inner side of the front piece and/or the rear piece is provided with dot-shaped glues.

4 Claims, 1 Drawing Sheet

(58) Field of Classification Search
USPC ..... 450/41
See application file for complete search history.

(56) References Cited

U.S. PATENT DOCUMENTS

| | | | | |
|---|---|---|---|---|
| 2013/0027846 | A1* | 1/2013 | Ashino | H01G 9/08 29/25.03 |
| 2016/0044971 | A1* | 2/2016 | Randall | A41C 3/142 450/39 |
| 2019/0021406 | A1* | 1/2019 | Funk-Danielson | A41C 3/0057 |
| 2020/0323278 | A1* | 10/2020 | Roddis | A41C 3/0014 |
| 2020/0397064 | A1* | 12/2020 | Liu | B32B 7/08 |
| 2021/0169153 | A1* | 6/2021 | Inselberg | A41C 3/0057 |

FOREIGN PATENT DOCUMENTS

| | | |
|---|---|---|
| CN | 213154026 | 5/2021 |
| CN | 213549719 | 6/2021 |
| CN | 215224837 | 12/2021 |

OTHER PUBLICATIONS

"Written Opinion of the International Searching Authority (Form PCT/ISA/237) of PCT/CN2022/092705," mailed on Jul. 28, 2022, pp. 1-9.

* cited by examiner

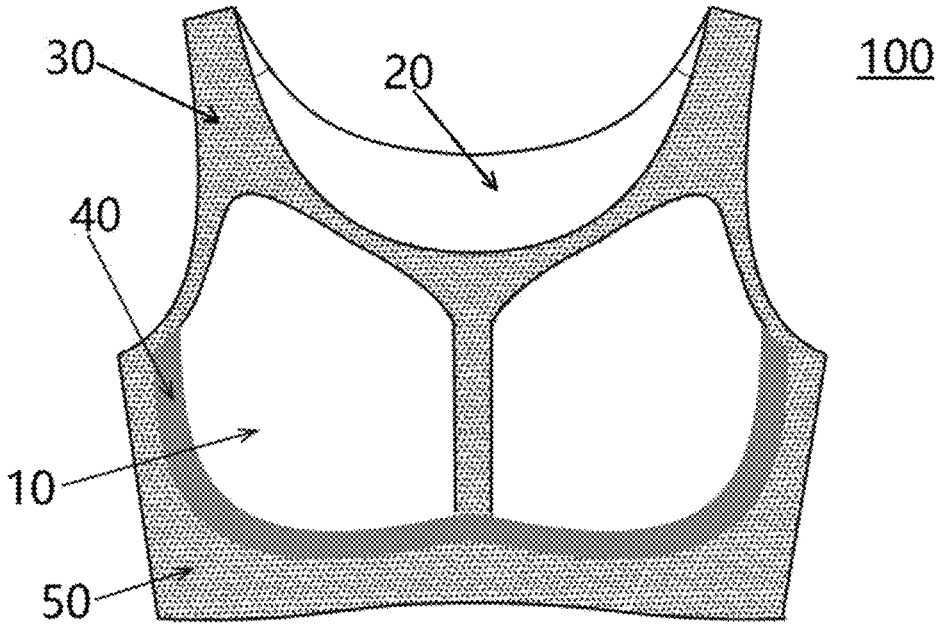
30
20
100
40
10
50

COMPOSITE SOFT SUPPORT SIZELESS BRA

CROSS-REFERENCE TO RELATED APPLICATIONS

This application is a 371 of international application of PCT serial No. PCT/CN2022/092705 filed on May 13, 2022, which claims the priority to China Application No. 202121050070.X filed on May 17, 2021. The entirety of each of the above mentioned patent applications is incorporated herein by reference and made a part of this specification.

BACKGROUND

Technical Field

The present application relates to underwear, in particular to a composite soft support sizeless bra.

Description of Related Art

Bra (also known as brassiere) is one of the underwear used by women to cover the private parts and support the breasts. At present, the bras on the market are mainly divided into two categories, one is that the bottom of the cup of the bra is provided with a steel ring structure, and the other is that the bottom of the cup of the bra is provided with a soft support structure. Due to the hard material of the steel ring, women usually feel uncomfortable with the steel ring when using this type of bra. Therefore, bras with soft support structures are more popular among women.

The soft support structure of the soft support structure bra is usually in the shape of a thin strip, and the silicone material is used for large-area bonding, so as to achieve a stronger support effect by limiting the elastic elongation of the fabric. However, the large area of silicone material used in soft support structure bra greatly restricts the elasticity of the fabric, resulting the soft support structure bra can only be worn in different sizes, and the body size range compatible with the same product is narrow. In order to avoid the problem that a person with larger circumference has a strong feeling of compression and a person with smaller circumferences feel loose when wearing, it is necessary to add products with different circumferences to match more people. For example, using the FZT 73012 bra size standard (the change in each size is 5 cm), there are 5 sizes 75B, 75C, 75D, 75E and 75F in a size M bra with a bust of 75 CM, corresponding to 5 circumferences. The large number of bras is not only unfavorable for production, but also increases the inventory pressure of merchants. It is worth noting that losing fat and losing weight has become a trend for modern women, resulting in everyone's body shape is not fixed. As a part of fat accumulation, the chest is faced with the situation of being large and small during the period of fat reduction and rebound.

In order to meet the needs of people with different body circumferences and different body types for bras, the dispensing technology can be used in bra. The dispensing technology combines the elasticity of the fabric and the dispensing process, so that the elasticity of the dispensing gap of the fabric is maintained. Since the glue material used in the dispensing technology basically has no resilience, it can only limit the stretching of the fabric at the glue point position, and the glue point position is relatively light and thin, the bra fabric will be repeatedly stretched for a long time, resulting in a certain degree of fatigue and looseness. The looseness leads to the weakening of the chest support effect, the easy falling of the shoulder straps, the shorter product life, and the visual sagging of the chest.

Therefore, there is an urgent need to develop a bra that can take into account the effects of support and one size suitable for various circumferences.

SUMMARY

According to one aspect of the present application, there is provided a composite soft support sizeless bra, comprising:

- a front piece;
- a soft support rubber strip, which is arranged on an inner side of the front piece, and is connected to a bottom part of the front piece by a shoulder strap to form a W shape, a U-shape, a straight shape, an arc shape or a curved shape;
- a rear piece, which is integrally formed with the front piece; and
- a shoulder strap, which is configured to connect the front piece and the rear piece; wherein,
- the inner side of the front piece and/or the rear piece is provided with dot-shaped glues.

In some embodiments, the soft support rubber strip is adhered to the inner side of the front piece.

In some embodiments, the front piece is made of double-layer fabrics, and the soft support rubber strip is sandwiched between the double-layer fabrics of the front piece.

In some embodiments, the front piece, the rear piece and the shoulder strap are all made of all-elastic fabric.

In some embodiments, an elastic elongation of the all-elastic fabric is greater than or equal to 110%.

In some embodiments, a thickness of the soft support rubber strip is 0.1 mm-3 mm, and a width of the soft support rubber strip is 1.2 cm-4 cm.

In some embodiments, the width of the soft support rubber strip is 1.2 cm-2 cm.

In some embodiments, a diameter of the dot-shaped glue is 1 mm-2 mm.

In some embodiments, a shape formed by the dot-shaped glues provided above or below the soft support rubber strip is consistent with a shape of the soft support rubber strip.

In some embodiments, the composite soft support sizeless bra is a vest bra, a back hook bra, a camisole bra with strap or a bra-in vest bra.

According to the detailed description of the specific embodiments of the present application in combination with the accompanying drawings, those skilled in the art will more clearly understand the above and other objects, advantages and features of the present application.

BRIEF DESCRIPTION OF THE DRAWINGS

Hereinafter, some specific embodiments of the present application will be described in detail by way of example and not limitation with reference to the drawings. The same reference signs in the drawings designate the same or similar components or parts. Those skilled in the art should understand that these drawings are not necessarily drawn to scale. In the drawings:

FIGURE is a schematic perspective view of a composite soft support sizeless bra according to one embodiment of the present application.

DESCRIPTION OF THE EMBODIMENTS

The FIGURE is a schematic perspective view of a composite soft support sizeless bra 100 according to one embodiment of the present application. As shown in the FIGURE, in this embodiment, a composite soft support sizeless bra 100 includes a front piece 10, a rear piece 20, a shoulder strap 30, a soft support rubber strip 40 and dot-shaped glues 50.

The front piece 10 is worn on the wearer's chest and is made of double-layered fabric. The soft support rubber strip 40 is sandwiched between the double layers of the front piece 10. As shown in the FIGURE, the soft support rubber strip 40 is connected to the bottom part of the front piece 10 by the front shoulder strap 30, and the soft support rubber strip 40 has a W shape. The soft support rubber strip 40 has the function of lifting, supporting and gathering from bottom to top, so as to fix and concentrate the periphery of the chest and prevent shaking and tremor. In specific implementation, the soft support rubber strip 40 can also be designed into U-shape, straight shape and different half-circle shapes such arc shape or curve shape. The half-circle shapes structural can not only ensure the elasticity of the bottom part of bra, but also can stick to the root of the breast, so as to have a supporting effect. In addition, the soft support rubber strip 40 can be designed to have different thicknesses, for example, 0.1 mm-3 mm. Since the soft support rubber strip 40 has a certain thickness, it has strong supporting force, good ductility and good resilience, and can still maintain elasticity while being repeatedly stretched. At the same time, the soft support rubber strip 40 is less deformed after repeated stretching, and can provide good support to the chest when applied to the bottom part of the bra. The width of the soft support rubber strip 40 could be 1.2 cm-4 cm. In specific implementation, the width of the soft support rubber strip 40 can be generally set to 1.2 cm-2 cm, and the width of the soft support rubber strip 40 can be set to 3 cm-4 cm on a bra with a wide lower band. The matching of the soft support rubber strip 40 and the width of the lower band of the bra can provide a comfortable wearing feeling.

The soft support rubber strip 40 can realize high-temperature adhesion. The soft support rubber strip 40 is placed between the double-layer fabrics of the front piece 10, and the soft support rubber strip 40 is fixed in the double-layer fabric by high-temperature bonding, which increases the supportability of the bra and realizes the sewing without using stitches, and provides a traceless wearing experience. The soft support rubber strip can also be arranged on the inner side of the front piece 10, and is fixed on the front piece 10 by high-temperature bonding. The composite soft support sizeless bra 100 is fitted to the wearer's skin when worn, so as to achieve better fixation effect.

As shown in the FIGURE, the inner side of the front piece 10 and/or the rear piece 20 is provided with dot-shaped glues 50. The quantity of the dot-shaped glues 50 can be flexibly chosen according to the strength requirements of each position of the bra. For example, the dot-shaped glues 50 can be distributed around the edge of the outer contour of the front piece 10, or can be distributed between the two cups of the front piece 10, and can also be distributed on the front piece 10, the rear piece 20 or the shoulder strap 30. Moreover, the shape formed by the dot-shaped glues 50 can be consistent with the soft support rubber strip 40, and can be arranged above or below the soft support rubber strip 40. The diameter of the dot-shaped glue 50 is usually set to 1 mm-2 mm. The combination of the dot-shaped glues 50 and the soft support rubber strip 40 can increase the uniform pressure on the position that needs to be supported to provide a support effect, and can use the high elastic performance of the fabric in other positions, so that the bra has a wearing fit that is suitable for the multi-body circumference while supporting.

The soft support rubber strip 40 fits the structure of the bottom of the breast, achieves a more support effect, provides invisible support for people with sagging breasts, and at the same time, it can avoid the disadvantage that the support capacity of the dispensing bra becomes weak when wearing it for a long time, and solve the problem of looseness and weakened support effect caused by repeated stretching of high elastic fabric bra products, and provides women with underwear that is both comfortable and supportive.

The shoulder strap 30 is worn on the shoulder of the wearer, and are connected to the front piece 10 and the rear piece 20. The rear piece 20 is worn on the back of the wearer, and is integrally formed with the front piece 10. In this embodiment, the front piece 10, the rear piece 20 and the shoulder strap 30 are all made of all-elastic fabric with high-stretch and high-resilience. More specifically, the elastic elongation of the all-elastic fabric in the transverse and longitudinal directions is greater than or equal to 110%.

The bra structure of the present application can reduce the looseness of the fabric after repeated stretching, and has better resilience performance, thereby increasing the support performance of the product. The adhesive technology adopted in the present application makes it possible to place the soft support rubber strip 40 while avoiding the use of stitching for fixation, and the close-fitting feeling is smoother. The soft support structure combined with the dispensing technology of the present application can be adapted to bras with different fabrics and different structures, such as vest bras, back hook bras, camisole bra with straps or bra-in vest bras, etc.

It should be noted that, unless otherwise specified, the technical or scientific terms used in this application should have the general meanings understood by those skilled in the art to which this application belongs.

The composite soft support sizeless bra of the present application combines the soft support structure with the dispensing technology, the soft support rubber strip with supporting effect is used locally at the bottom of the bra, and the dispensing technology is used at other positions, which can maintain the lightness and elasticity of the bra and have both the effects of support and better elasticity.

The present application uses the characteristics of the soft support rubber strip to make the one-size bra have better support, and has the characteristics of light and thin adhesion of other parts, so as to achieve the effect of more support for women's breasts and long-term wearing comfort, and to a certain extent, alleviates the problem of fabric looseness, improves the service life of the bra, and makes the bra more cost-effective. At the same time, sizeless bras are suitable for a variety of body types with different circumferences, which is conducive to more convenient production of bras, reduces inventory for merchants, and is more suitable for the living habits of modern women, improving user experience.

The above are only the preferred specific embodiments of the present application, but the protection scope of the present application is not limited to this. Any change or replacement that can be easily thought of by any person skilled in the art within the technical scope disclosed in the present application shall be covered by the protection scope of the present application. Therefore, the scope of protection of this application should be subject to the scope of protection of the claims.

What is claimed is:

1. A composite soft support sizeless bra, comprising: a front piece; a soft support rubber strip, arranged on a bottom part of the front piece and an inner side of the front piece to form a W-shape, a U-shape, a straight shape, an arc shape or a curved shape a rear piece, which is integrally formed with the front piece; and the shoulder strap, which is configured to connect the front piece and the rear piece; wherein, the inner side of the front piece and/or the rear piece is provided with dot-shaped glues, the front piece is made of double-layer fabrics, and the soft support rubber strip is sandwiched between the double-layer fabrics of the front piece, the front piece, the rear piece and the shoulder strap are all made of all-elastic fabric, and the all-elastic fabric has an elastic elongation of greater than or equal to 110%; wherein a thickness of the soft support rubber strip is 0.1 mm-3 mm, and a width of the soft support rubber strip is 1.2 cm-4 cm; wherein the width of the soft support rubber strip is 1.2 cm-2 cm.

2. The composite soft support sizeless bra according to claim 1, wherein the soft support rubber strip is adhered to the inner side of the front piece.

3. The composite soft support sizeless bra according to claim 1, wherein a diameter of the dot-shaped glue is 1 mm-2 mm.

4. The composite soft support sizeless bra according to claim 1, wherein a shape formed by the dot-shaped glues provided above or below the soft support rubber strip is consistent with a shape of the soft support rubber strip.

* * * * *